US007597422B2

(12) United States Patent
Katayama et al.

(10) Patent No.: US 7,597,422 B2
(45) Date of Patent: Oct. 6, 2009

(54) INK-JET PRINTER, HEAD FOR INK-JET PRINTER AND FLEXIBLE CABLE USABLE FOR THE SAME

(75) Inventors: Naoki Katayama, Kariya (JP); Yoshikazu Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 512 days.

(21) Appl. No.: 11/493,579

(22) Filed: Jul. 27, 2006

(65) Prior Publication Data

US 2007/0024674 A1 Feb. 1, 2007

(30) Foreign Application Priority Data

Jul. 28, 2005 (JP) ..... 2005-218994

(51) Int. Cl.
*B41J 2/14* (2006.01)
*B41J 2/16* (2006.01)

(52) U.S. Cl. ..... 347/50; 347/68

(58) Field of Classification Search ..... 347/50, 347/57–59, 68, 70, 71
See application file for complete search history.

(56) References Cited

U.S. PATENT DOCUMENTS 7,004,565 B2 2/2006 Suzuki et al. ..... 347/50
7,434,914 B2 * 10/2008 Ito ..... 347/50

FOREIGN PATENT DOCUMENTS

JP 2003311953 11/2003
JP 2004114609 4/2004

* cited by examiner

*Primary Examiner*—Juanita D Stephens
(74) *Attorney, Agent, or Firm*—Baker Botts L.L.P.

(57) ABSTRACT

The ink-jet printer head includes a cavity unit which has a plurality of pressure chambers arranged in a plurality of pressure-chamber rows; an actuator unit which has individual surface electrodes corresponding to the pressure chambers respectively, and land portions conducted to the individual surface electrodes respectively; and a flexible cable which has connection terminals and signal lines. The land portions and the connection terminals are electrically connected. In each of the pressure-chamber rows, the land portions are arranged such that a certain land portion is shifted from another land portion adjacent to the certain land portion in a longitudinal direction of the pressure chambers. Accordingly, even when the pressure chambers are arranged highly densely, it is possible to electrically connect the flexible cable and the actuator unit easily.

16 Claims, 11 Drawing Sheets

INK-JET PRINTER, HEAD FOR INK-JET PRINTER AND FLEXIBLE CABLE USABLE FOR THE SAME

CROSS REFERENCE TO RELATED APPLICATION

The present application claims priority from Japanese Patent Application No. 2005-218994, filed on Jul. 28, 2005, the disclosure of which is incorporated herein by reference in the entirety.

BACKGROUND OF THE INVENTION

1. Field of the Invention

The present invention relates to an ink-jet printer, a head for the ink-jet printer, and a flexible cable usable for the ink-jet printer head.

2. Description of the Related Art

As an ink-jet printer which performs recording on a recording medium by discharging an ink, there is an ink-jet printer which is hitherto widely known and which is provided with a cavity unit which has a plurality of nozzles, a plurality of pressure chambers communicating with the nozzles respectively, and a manifold temporarily storing an ink to be supplied to the pressure chambers; and an actuator unit which has a plurality of individual electrodes formed corresponding to the pressure chambers, respectively, and which supplies driving voltage to the individual electrodes so as to change volume of the pressure chambers corresponding to the individual electrodes, respectively, thereby discharging the ink from the nozzles.

As such an ink-jet printer, an ink-jet printer is known which has individual surface electrodes, auxiliary electrodes (land portions, adhesion land portions or weld land portions) electrically conducted to the individual surface electrodes respectively and not overlapping in a plan view with the pressure chambers respectively; and in which the auxiliary electrodes are aligned in rows in one direction to be connected to connection pads (connection terminal portions), respectively, of signal lines of a flexible cable (see, for example, FIGS. 10A to 10D of U.S. Pat. No. 7,004,565 which correspond to FIGS. 10(a) to 10(d) of Japanese Patent Application Laid-open No. 2003-311953).

In the recent years, in an ink-jet printer, there is an attempt to miniaturize the head and to highly densify the nozzles (to arrange the nozzles highly densely) in response to the demand for high-speed printing and improvement of printed image and/or letter. For this purpose, it is demanded to make the pitch of nozzles as narrow as possible. In the ink-jet head described in U.S. Pat. No. 7,004,565, however, there is a problem that in a flexible cable (FPC, COF or COP) used for connecting the individual surface electrodes of the actuator unit to a control board, signal lines (a conductive pattern formed on a substrate which is flexible and has insulating property), connected to the adhesion land portions corresponding to the individual surface electrodes, respectively, are concentrated (congested) on a side of the flexible cable at which the signal lines are drawn, thereby increasing the number of signal lines on this side of the flexible cable. Accordingly, the wiring (line) pitch of the signal lines (conductive pattern) becomes narrow and thus it is difficult to realize a miniaturized head and densified nozzles (nozzles which are arranged highly densely).

Further, there is a wiring structure which is also hitherto known and in which head terminals, arranged on and conducted to surface electrodes, respectively, of the ink-jet head, are arranged in a staggered manner, thereby arranging terminal electrodes, which are connected to the head terminals respectively, also in a staggered manner (see, for example, FIG. 4 of U.S. Patent Application Publication No. US 2004/0060969 A1 corresponding to FIG. 4 of Japanese Patent Application Laid-open No. 2004-114609).

However, even when the head terminals of the surface electrodes and the terminal electrodes of the flexible cable in the ink-jet head are formed in a staggered manner, as in the wiring construction described in U.S. Patent Application Publication No. US 2004/0060969 A1, the sizes of the head terminals and terminal electrodes cannot be made to be reduced substantially for the following reason. That is, when the sizes of the head terminals and the terminal electrodes are reduced to be small, there is a fear that the electrical connection cannot be performed successfully if the head terminals and/or the terminal electrodes are deviated from (moved out of) their positions even by a small amount while performing the connection. Therefore, in such a wiring construction, the pitch of the signal lines of the flexible cable is still narrow, which in turn makes it difficult to further arrange the nozzles highly densely.

For this reason, in order to advance the further densification of the nozzles and to increase the number of the individual surface electrodes, it is necessary to use a plurality of flexible cables (for example, FPC, COP or COF). However, the increase in the number of flexible cables not only weakens the mechanical strength of the wiring connection considerably but also increase the production cost.

SUMMARY OF THE INVENTION

An object of the present invention is to provide a head for an ink-jet printer, which is provided with densely arranged nozzles and which is electrically connectable to an actuator adopted to correspond to the densely arranged nozzles without using a plurality of flexible cables; a flexible cable usable for connection with the head for the ink-jet printer; and an ink-jet printer provided with the flexible cable.

According to a first aspect of the present invention, there is provided a head for ink-jet printer which discharge an ink, the head including:

a cavity unit including a plurality of nozzles, a plurality of elongated pressure chambers communicating with the nozzles respectively, and a manifold storing the ink to be supplied to the pressure chambers;

an actuator unit having individual surface electrodes which are formed corresponding to the pressure chambers, respectively; and land portions which are conducted to the individual surface electrodes respectively and which are formed, corresponding the pressure chambers respectively, such that a land portion among the land portions is formed between an individual surface electrode, among the individual surface electrodes and conducted with the land portion, and another individual surface electrode adjacent to the individual surface electrode; the actuator changing volume of the pressure chambers respectively, when driving signal is supplied to the individual surface electrodes respectively, so as to discharge the ink from the nozzles; and a flexible cable arranged to overlap with the actuator unit, and having a flexible and insulative substrate, a plurality of connection terminals which are formed on the substrate, and signal lines formed on the substrate and drawn from the connection terminals respectively; wherein:

the land portions are electrically connected to the connection terminals, respectively; and three land portions, among the land portions, which are adjacent to one another in a short direction of the pressure chambers and on a signal-line drawn side at which the signal lines are drawn, are arranged to shift from one another in a longitudinal direction of the pressure chambers. Here, the term "on the signal-line drawn side" is intended to also include a case in which land portions (adhesion land portions, weld land portions), which are other than the land portion on the signal-line drawn side, are not shifted in the longitudinal direction of the pressure chambers.

According to the first aspect of the present invention, since the land portions are arranged such that a certain land portion is shifted, in the longitudinal direction of the pressure chamber, from another land portions which are adjacent to the certain land portion intervening the certain land portion therebetween, the distance (spacing distance) between the land portions is wider than in a case in which the land portions are aligned in a horizontal row (for example, in the short direction of the pressure chambers). Accordingly, in the flexible cable, on the side at which the signal lines are drawn (the signal-line drawn side) and at which the wiring pitch of the signal lines is the narrowest, the signal lines formed as a conductive pattern can be wired, in a non-tight or non-narrow manner (without making the signal lines arranged very narrowly or tightly), between the connection terminals, of the flexible cable, which are to be electrically connected to the land portions. In other words, a space for wiring or drawing the signal lines in the flexible cable is secured reasonably by devising a method for arranging the land portions which are electrically conducted to the individual surface electrodes, respectively, and which are arranged between the individual surface electrodes adjacent to one another. Therefore, without using a plurality of flexible cables (for example, FPC, COP, COF or the like), it is possible to electrically connect the land portions, of the actuator, formed corresponding to the densely arranged pressure chambers, to the connection terminals of the flexible cable, in an easy and inexpensive manner.

In the head for the ink-jet printer of the present invention, the pressure chambers may form a plurality of pressure-chamber rows aligned in a row-direction which is different from the longitudinal direction;

the signal lines may be drawn in a direction intersecting the row-direction; and the land portions may be arranged such that, a land portion, among the land portions, which is conducted to an individual surface electrode among the individual surface electrodes and corresponding to a pressure chamber forming a pressure-chamber row among the pressure-chamber rows and being on the signal-line drawn side, is arranged between the individual surface electrode and another individual surface electrode corresponding to another pressure chamber which is adjacent to the pressure chamber and which also forms the pressure-chamber row on the signal-line drawn side.

With such an arrangement, at least in the pressure-chamber row on the signal-line drawn side, a land portion, which is conducted to an individual surface electrode corresponding to a certain pressure chamber belonging to the pressure-chamber row, is arranged at a space (position) between the individual surface electrode and another individual surface electrode which is adjacent to the individual surface electrode and corresponding to another pressure chamber adjacent to the pressure chamber in the same pressure-chamber row. Therefore, the spacing distance between the land portions becomes wider than in a case in which the land portions are aligned immediately lateral to one another or in a horizontal row. Accordingly, it is advantageous from a viewpoint of securing reasonably the wiring space of the signal lines of the flexible cable.

In the head for the ink-jet printer of the present invention, land portions, among the land portions, which correspond to pressure chambers, respectively, among the pressure chambers and forming one of the pressure-chamber rows, may form a plurality of land portion groups which are adjacent to each other and each of which includes land portions adjacent to one another; and an arrangement pattern, in which the land portions are arranged, may be same among the land portion groups.

Accordingly, by dividing land portions corresponding to pressure chambers within a same pressure chamber row into land portion groups and by repeating the same arrangement pattern for each of the groups, it is possible to simplify the arrangement of the land portions to be connected to the connection terminals of the flexible cable (signal lines).

In the head for the ink-jet printer of the present invention, the land portions, forming each of the land portion groups, may be arranged along a straight line inclined with respect to the longitudinal direction of the pressure chambers.

Accordingly, by arranging the land portions on a straight line inclined with respect to the longitudinal direction of the pressure chambers, the spacing distance between the land portions becomes wide. This consequently widens the spacing distance between the connection terminals arranged corresponding to the land portions, respectively, and it is possible to arrange or draw the signal lines of the flexible cable in a non-narrow manner (with enough space).

In the head for the ink-jet printer of the present invention, the land portions forming each of the land portion groups may be arranged one by one at a constant spacing distance in the longitudinal direction of the pressure chambers; and a spacing distance in the longitudinal direction of the pressure chambers may be widest between land portions among the land portions and located at both ends, respectively, in each of the land portion groups, and remaining land portions, except for the land portions located at the both ends, may be arranged to deviate from a straight line connecting the land portions located at the both ends in each of the land portion groups.

Accordingly, the spacing distance between two land portions, located at the both ends, respectively, in each of the land portion groups, becomes the widest in each of the groups, and thus the signal lines of the flexible cable can be easily wired or drawn in a non-narrow manner (with enough space). In addition, the remaining land portions, other than the two land portions located at the both ends in each of the land portion groups, are arranged to deviate, from a straight line connecting the two land portions located at the both ends. Accordingly, upon electrically connecting the connection terminals of the flexible cable and the land portions of the actuator unit, it is possible to press the flexible cable and the actuator unit in a balanced manner.

In the head for the ink-jet printer of the present invention, notches may be formed in the individual surface electrodes, respectively, each of the notches corresponding to a land portion among the land portions and conducted to an individual surface electrode among the individual electrodes and adjacent to another individual surface electrode in which each of the notches is formed.

Accordingly, by forming the notches of which electrode portions are partially cut, respectively, in the individual surface electrodes, it is possible to prevent a short circuit of a land portion and an adjacent individual surface electrode from being inadvertently caused due to an excessive solder at the time of soldering or the like.

In the head for the ink-jet printer of the present invention, the row-direction of the pressure-chamber rows may be orthogonal to the longitudinal direction of the pressure chambers; and a direction in which the signal lines are drawn may be parallel to the longitudinal direction of the pressure chambers.

Accordingly, since the signal lines are drawn in a same direction which is substantially parallel to the longitudinal direction of the pressure chambers, the wiring (drawing) of the flexible cable is simplified, and the production becomes easy.

In the head for the ink-jet printer of the present invention, the pressure chambers may include color-designated (color-specific) pressure chambers to which a plurality of color inks are supplied respectively, the color inks including a black ink; and the black ink may be supplied to a color-divided pressure chamber among the color-divided pressure chambers and corresponding to an individual electrode among the individual electrodes and being on the signal-line drawn side.

The length of the pressure chamber(s) for the black ink, for which a large ink discharge amount is required, generally has a length greater than that of other pressure chamber(s) for other color(s) other than black for purpose of the stable ink discharge. In such a case, the length of the individual surface electrode formed corresponding to the pressure chamber for the black ink is also greater than other individual electrode(s) corresponding to the pressure chamber(s) for other color(s). Since the length of the individual electrode corresponding to the pressure chamber for the black ink can be great, the wiring pitch for the signal lines of the flexible cable can be reasonably secured with enough space or in a non-narrow manner.

In the head for the ink-jet printer of the present invention, the actuator unit may further include inner electrodes formed above the pressure chambers, respectively, and piezoelectric sheets each formed on a surface of one of the inner electrodes; and each of the individual surface electrodes may be formed on a surface of one of the piezoelectric sheets.

The actuator unit applies pressure to the pressure chambers by the deformation of the actuator sheets as a whole. Since the land portions are arranged in the piezoelectric sheets, respectively, at areas which are between the individual surface electrodes and separated or away from the deformable or deforming portions (portions of the piezoelectric sheets at each of which one of the individual surface electrodes is formed), there is no fear that the land portions affect the pressure application to the pressure chambers by the deformation of the piezoelectric sheets. On the other hand, in a construction in which the signal lines of the flexible cable are connected, with solder, directly to the individual surface electrodes formed on the piezoelectric sheets, the rigidity of the individual surface electrodes becomes great at the soldered portions, and the piezoelectric sheets are difficult to be deformed.

In the head for the ink-jet printer of the present invention, with respect to all of the land portions, three land portions among the land portions and adjacent to one another in the short direction of the pressure chambers may be arranged to shift from one another in the longitudinal direction of the pressure chambers. In this case, the degree of freedom in arranging (drawing) the signal lines of the flexible cable becomes higher than in a case that, with respect only to land portions disposed most closely on the signal-line drawn side at which the signal lines are drawn, three land portions adjacent to one another in the short direction of the pressure chambers are arranged to be shifted from one another in the longitudinal direction of the pressure chambers.

In the head for the ink-jet printer of the present invention, with respect to land portions among the land portions and being on the signal-line drawn side, four land portions which are adjacent to one another in the short direction of the pressure chambers may be arranged to shift from one another in the longitudinal direction of the pressure chambers. In this case, the wiring pitch of the signal lines of the flexible cable can be wider (increased) than in a case that only three land portions, among the land portions, which are adjacent to one another in the short direction of the pressure chambers and on the signal-line drawn side, are arranged to shift from one another in the longitudinal direction of the pressure chambers.

The head for the ink-jet printer of the present invention may include only one piece of the flexible cable. In this case, since the head does not use a plurality of flexible cables, it is possible to enhance the reliability of the electrical connection and mechanical connection between the land portions and connection terminals.

According to a second aspect of the present invention, there is provided a flexible cable connectable to an head for an ink-jet printer, the head including: a cavity unit including a plurality of nozzles, a plurality of elongated pressure chambers communicating with the nozzles respectively, and a manifold storing an ink to be supplied to the pressure chambers; and an actuator unit having individual surface electrodes corresponding to the pressure chambers, respectively, and land portions which are conducted to the individual surface electrodes respectively and which are formed, corresponding the pressure chambers respectively, such that a land portion among the land portions is formed between an individual surface electrode, among the individual surface electrodes and conducted with the land portion, and another individual surface electrode adjacent to the individual surface electrode, the actuator changing volume of the pressure chambers respectively, when driving signal is supplied to the individual surface electrodes respectively, so as to discharge the ink from the nozzles, the flexible cable including:

a flexible and insulative substrate which is band-shaped;

a plurality of connection terminals which are formed on the substrate; and a plurality of signal lines formed on the substrate and drawn, in an extending direction in which the substrate extends, from the connection terminals respectively, the signal lines supplying driving signal to the individual surface electrodes respectively;

wherein three connection terminals, among the connection terminals, which are adjacent to one another in a direction different from the extending direction and arranged in the substrate on a signal-line drawn side at which the signal lines are drawn, are formed at positions shifted from one another in the extending direction According to the second aspect of the present invention, at least in the three land portions on the signal-line drawn side, a certain land portion which corresponds to a certain individual surface electrode on the signal-line drawn side and land portions which are at both ends of the certain land portion and which correspond to individual surface electrodes adjacent to the certain individual electrode are located at positions shifted from one another in the longitudinal direction of the pressure chambers, and the connection terminals of the flexible cable are arranged to correspond to the land portions, conducted to the individual surface electrodes, respectively. Accordingly, it is possible to make the spacing distance between the connection terminals to be wide. In such a manner, by making the spacing distance between the connection terminals to be wide, the signal lines (of the flexible cable) can be wired (drawn) in a non-narrow manner between the connection terminals. Therefore, the electrical connection between the connection terminals of the flexible cable and the individual surface electrodes, of the actuator unit, which are formed highly densely corresponding to the pressure chambers arranged highly densely, can be realized by using one piece of flexible cable (for example, FPC, COP or COF) in an inexpensive manner.

In the flexible cable of the present invention, each of the connection terminals may be a copper-foil portion formed with a through hole at a center of the copper-foil portion.

Accordingly, it is possible to electrically connect the connection terminals and the land portions respectively in a easy manner by filling solder or the like in the through hole formed in the center of the copper-foil portion.

According to a third aspect of the present invention, there is provided an ink-jet printer which discharges an ink to perform recording on a recording medium, the ink-jet printer including:

a head for ink-jet printer which includes a cavity unit having a plurality of nozzles, a plurality of elongated pressure chambers communicating with the nozzles, respectively, and a manifold storing the ink to be supplied to the pressure chambers; an actuator unit which has individual surface electrodes corresponding to the pressure chambers, respectively, and land portions which are conducted to the individual surface electrodes respectively and which are formed, corresponding the pressure chambers respectively, such that a land portion among the land portions is formed between an individual surface electrode, among the individual surface electrodes and conducted with the land portion, and another individual surface electrode adjacent to the individual surface electrode, the actuator changing volume of the pressure chambers respectively when driving signal is supplied to the individual surface electrodes respectively so as to discharge the ink from the nozzles; and a flexible cable arranged to overlap with the actuator unit and having a flexible and insulative substrate, a plurality of connection terminals formed on the substrate, and signal lines formed on the substrate and drawn from the connection terminals, respectively;

a carriage which is movable while supporting the head for ink-jet printer; and a drive control unit which is connected to one end of the flexible cable, which supplies the driving signal to the individual surface electrodes, and which supplies a signal for controlling drive of the carriage to the carriage;

wherein the land portions are electrically connected to the connection terminals, respectively; and three land portions, among the land portions, which are adjacent to one another in a short direction of the pressure chambers and on a signal-line drawn side at which the signal lines are drawn, are arranged at positions shifted from one another in the longitudinal direction of the pressure chambers.

According to the third aspect of the present invention, in the three land portions on the signal-line drawn side which are conducted with the individual surface electrodes on the signal-drawing side, a certain land portion which corresponds to a certain individual surface electrode on the signal-line drawn side and land portions which are at both ends of the certain land portion and which correspond to individual surface electrodes adjacent to the certain individual electrode are located at positions shifted from one another in the longitudinal direction of the pressure chambers. Accordingly, it is possible to make the spacing distance between the land portions to be wider than in a case in which the land portions are aligned in a horizontal row. Accordingly, the signal lines, of the flexible cable, formed as a conductive pattern, can be wired (drawn) in a non-narrow manner (with enough space) between the connection terminals electrically connected to the land portions also in the signal-line drawn side at which the wiring pitch of the signal lines is the narrowest.

In the ink-jet printer of the present invention, the head may include only one piece of the flexible cable. In this case, since the head of the ink-jet printer does not use a plurality of flexible cables, it is possible to enhance the reliability of the electrical connection and mechanical connection between the land portions and the connection terminals.

BRIEF DESCRIPTION OF THE DRAWINGS

FIGS. 4A and 4B show a first embodiment of the present invention, wherein FIG. 4A shows a relationship between the individual surface electrodes and pressure chambers, and FIG. 4B shows an arrangement of the connection terminals of the signal lines.

FIGS. 8A and 8B show an example of a first modified embodiment of the present invention, wherein FIG. 8A shows a relationship between the individual surface electrodes and pressure chambers, and FIG. 8B shows an arrangement of the connection terminals of the signal lines.

DETAILED DESCRIPTION OF THE PREFERRED EMBODIMENTS

In the following, embodiments of the present invention will be explained with reference to the drawings.

Figure 1A:
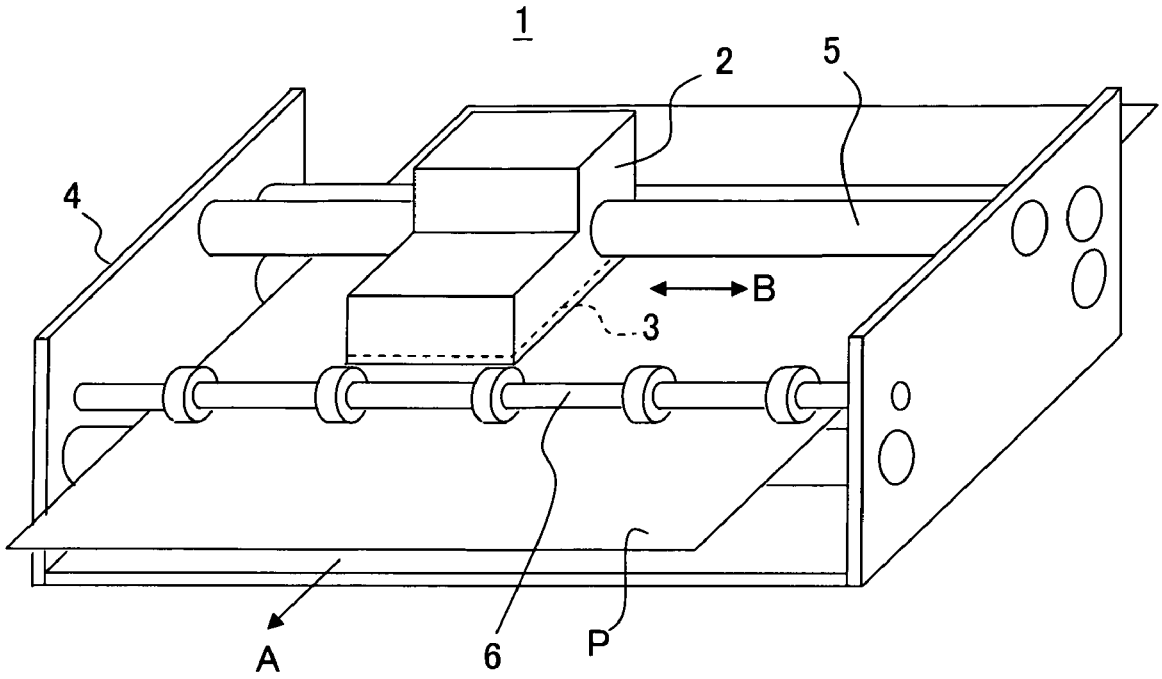
FIG. 1A is a schematic structural view of an ink-jet printer according to the present invention.
Figure 1B:
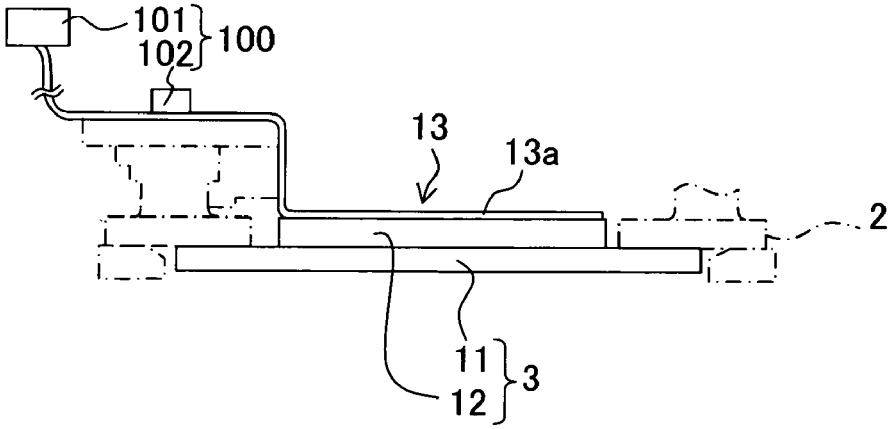
FIG. 1B is a diagram showing a relationship among a cavity unit, an actuator unit and a flexible flat cable (COP) according to the present invention.

FIG. 1A is a schematic structural view of an ink-jet printer 1 according to the present invention, and FIG. 1B is a diagram showing a relationship among a cavity unit, an actuator unit and a flexible flat cable (COP) of the ink-jet printer 1 according to the present invention.

The ink-jet printer 1 according to the present invention includes, as shown in FIG. 1A, a carriage 2 to which an ink cartridge (not shown) is provided, and a head 3 for ink-jet printer (hereinafter referred simply to as "head") which performs recording on a recording paper P (recording medium) and which is provided to a lower surface of the carriage 2. The carriage 2 is supported by a guide plate (not shown) and a carriage shaft 5 arranged in a printer frame 4, and is reciprocabale in a direction B orthogonal to a transporting direction A in which the recording paper P is feed or transported.

The recording paper P, transported from a paper feeding section (not shown) in the direction A, is introduced between a platen roller (not shown) and the head 3 to be subjected to a recording of a predetermined image or the like with an ink discharged from the head 3 onto the recording paper P, and then the recording paper P is discharged by discharge rollers 6.

Figure 2A:
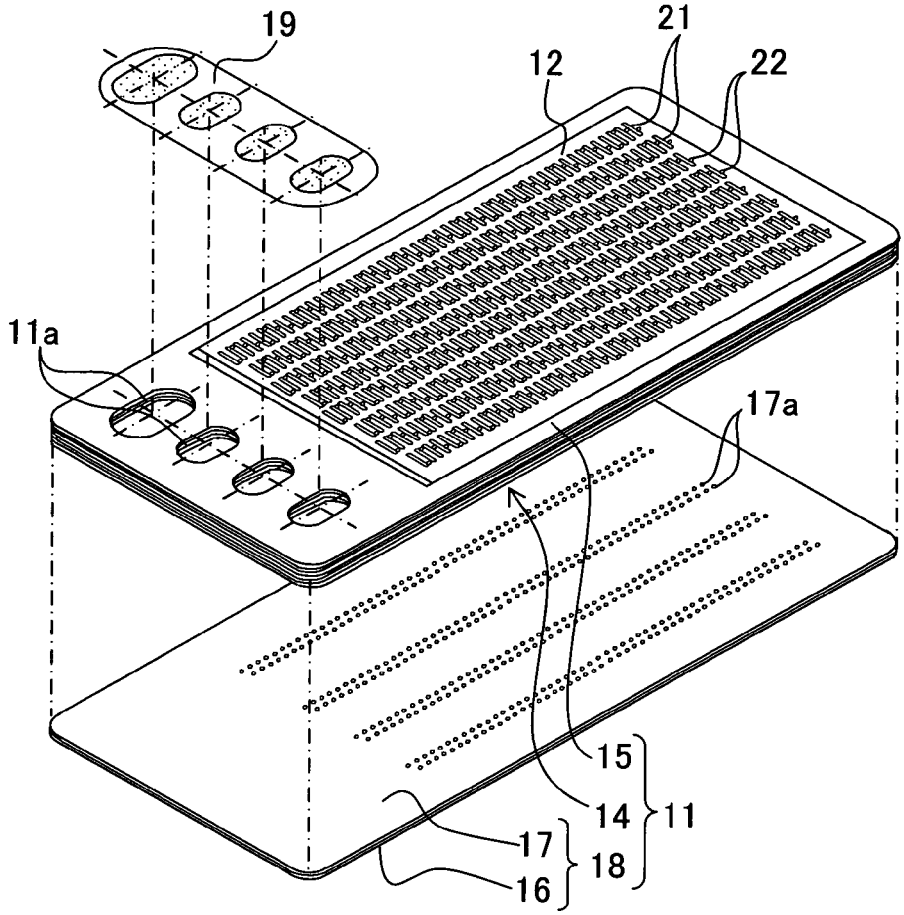
FIG. 2A is a diagram in which the cavity unit is exploded into a stack, and a nozzle plate and a spacer plate adhered to each other.
Figure 2B:
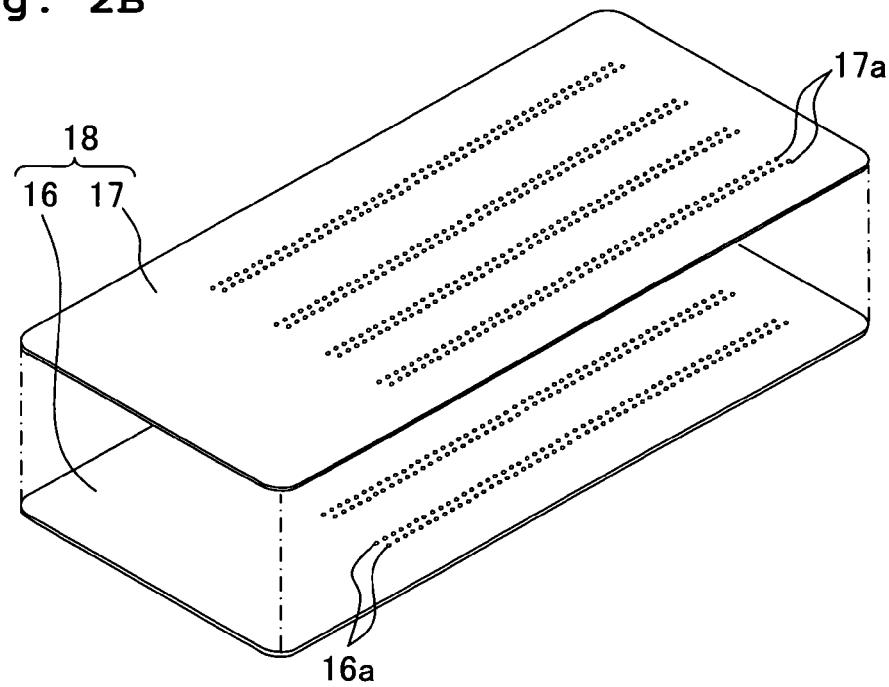
FIG. 2B is a diagram showing the nozzle plate and the spacer plate.

Further, as shown in FIGS. 1B and 2, the head 3 includes a cavity unit 11, an actuator unit 12 disposed on a lower side of the head in this order. A flexible cable 13 which includes signal lines and supplies drive signal is provided on the upper surface of the actuator unit 12. One end of the flexible cable 13 is connected to the actuator unit 12, and the other end of the flexible cable 13 is connected to a drive control unit 100. The drive control unit 100 includes a drive control section 101 which sends a signal for controlling the drive of the carriage 2, and a driver IC (IC) 102 which feeds or transmits drive signal (drive voltage) to individual surface electrodes of the actuator unit. The individual surface electrodes are formed corresponding to pressure chambers, respectively, and will be described later on.

Figure 3:
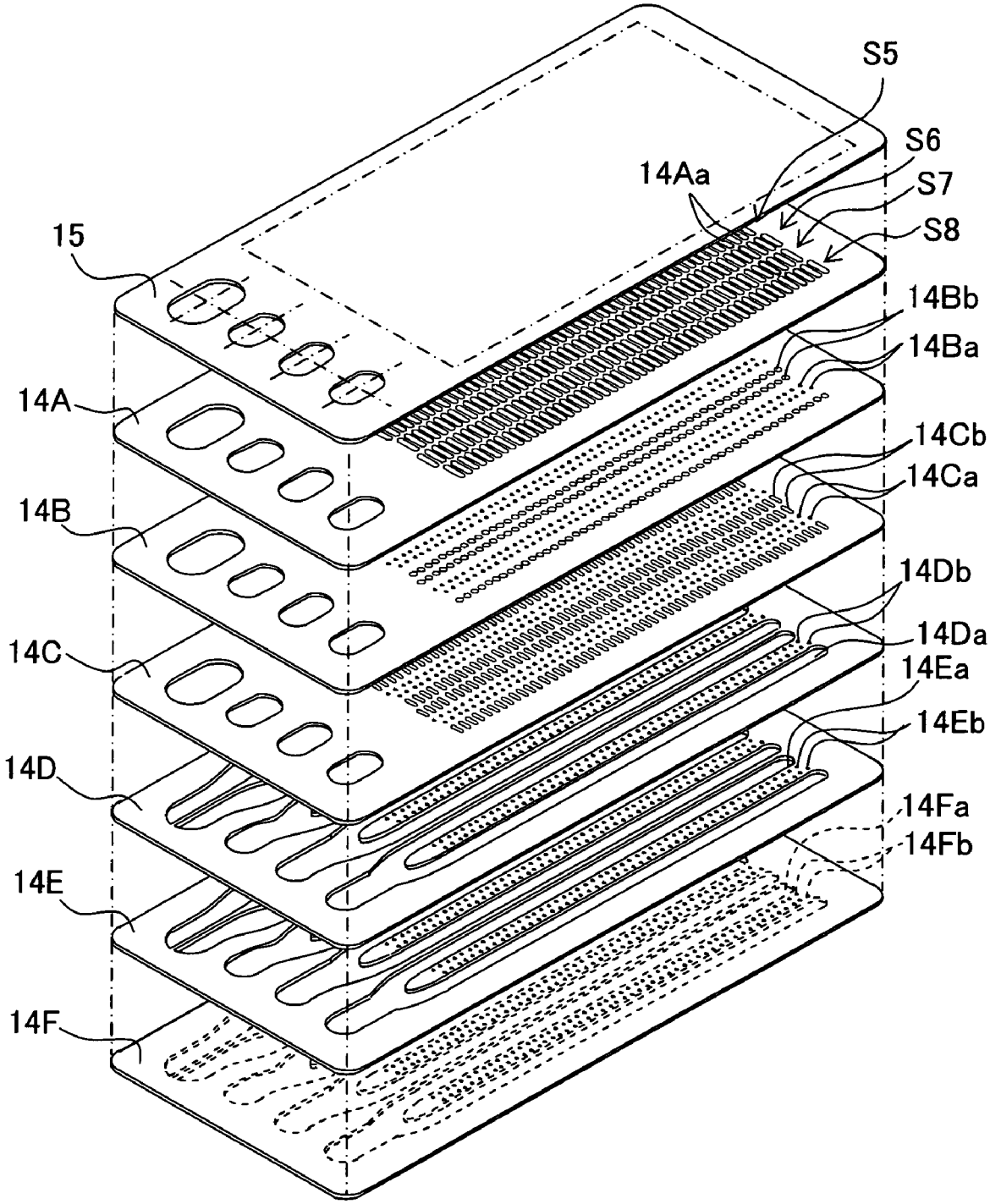
FIG. 3 is a diagram showing the stack which construct the cavity unit, exploding the stack into plates each constructing the stack and showing the stack together with a top plate.

As shown in FIG. 3, the cavity unit 11 includes a stack 14 formed of a plurality of plates. On the upper side of the stack 14, a top plate 15 which will be explained later is provided, and a plate assembly 18 is adhered to the lower side of the cavity unit 11 in an integrated manner. The plate assembly 18 is formed by joining (adhering) a nozzle plate 16 and a spacer plate 17 together.

As shown in FIG. 2A, the actuator unit 12 is provided on the upper side of the top plate 15. Further, the cavity unit 11 has openings 11*a* to each of which a filter 19 for capturing dust, dirt or the like existing in the ink is provided. The nozzle plate 16 is a plate which is made of synthetic resin (for example, polyimide) and has nozzles 16*a* formed therein, and each of the nozzles 16*a* corresponds to one of the pressure chambers 14Aa of a cavity plate 14A. The cavity plate 14A constructs the stack 14 and will be described later. Further, the spacer plate 17 is a metallic plate in which through holes 17*a*, corresponding to the nozzles 16*a* respectively, are formed. Alternatively, the nozzle plate 16 may be a metallic plate.

Figure 5:
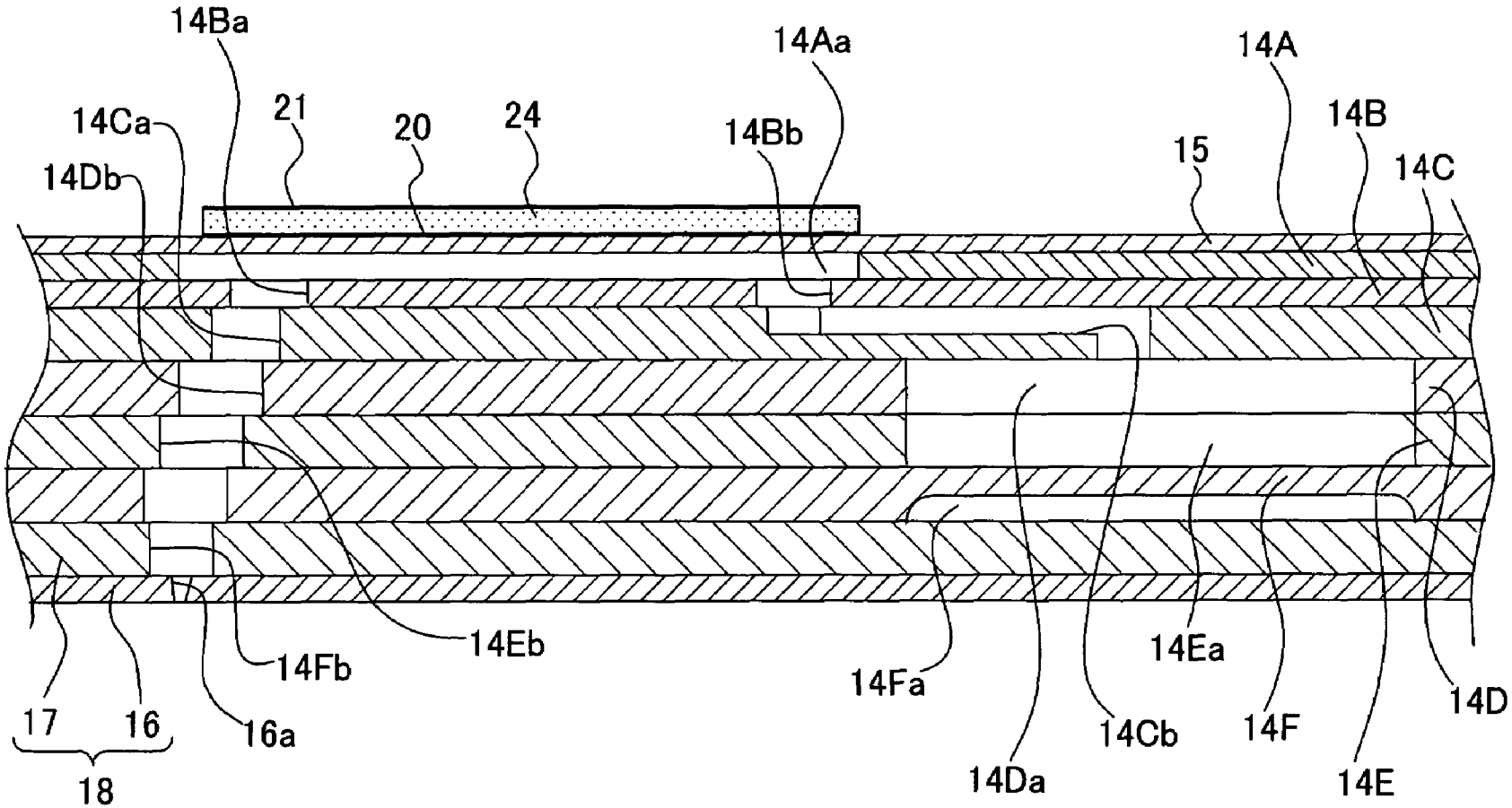
FIG. 5 is a cross-sectional view taken along a line V-V in FIG. 4A.

As shown in FIG. 5, the stack 14 is formed by overlaying (stacking) the cavity plate 14A, a base plate 14B, an aperture plate 14C, two manifold plates 14D, 14E, and a damper plate 14F from the upper side in this order, and by subjecting the plates to the metal diffusion bonding to bond the plate together. These six plates 14A to 14F are positioned with respect to one another and stacked on top of one another so as to form individual ink channels each communicating with one of the nozzles 16*a*. Here, in the metallic cavity plate 14A, a large number of through holes aligned in rows in a regular manner is formed, and the pressure chambers 14Aa are formed by these through holes respectively. In the metallic base plate 14B, through holes 14B, and through holes 14Bb are formed. The through holes 14Ba communicate manifolds 14Da, 14Ea (common ink chambers) with the pressure chambers 14Aa, and the through holes 14Bb communicate the pressure chambers 14Aa with the nozzles 16*a* respectively. Also in the metallic aperture plate 14C, through holes 14Ca and through holes 14Cb are formed. The through holes 14Cb communicate manifolds 14Da, 14Ea with the pressure chambers 14Aa, and the through holes 14Ca communicate the pressure chambers 14Aa with the nozzles 16*a* respectively. In the metallic manifold plate 14D, the manifold 14Da (common ink chamber) and through holes 14Db are formed and in the metallic manifold plate 14E, the manifold 14Ea (common ink chamber) and through holes 14Eb are formed. The through holes 14Db communicate each of the pressure chambers 14Aa to one of the nozzles 16, and the through holes 14Eb communicate each of the pressure chambers 14Aa to one of the nozzles 16*a*. In the metallic damper plate 14F, damper chambers 14Fa and through holes 14Fb are formed. The through holes 14Fb communicate the pressure chambers 14Aa with the nozzles 16*a* respectively.

The actuator unit 12 includes inner common electrodes 20 formed on the top plate 15 to correspond to the pressure chambers 14Aa, respectively; piezoelectric sheets 24 formed on the inner common electrodes 20, respectively; and surface electrodes 21 (individual surface electrodes) each of which formed on a surface of one of the piezoelectric sheets 24. The piezoelectric sheets 24 are formed of a ceramics material which is a lead zirconate titanate (PZT)-based material and is ferroelectric. Each of the piezoelectric sheets 24 is polarized in a thickness direction thereof. The surface electrodes 21 are made of a metallic material such as an Ag—Pd based material, and are connected to the drive control unit 100 provided with the driver IC 102 via signal lines 31, of the flexible cable 13, to which the drive signal is supplied. On the other hand, the inner common electrodes 20 are kept at a ground potential all the time. Accordingly, by making an electric potential of the surface electrodes 21 to be higher (or lower) than the ground potential, an electric field is applied to the piezoelectric sheets 24 in a polarization direction in which the piezoelectric sheets 24 are polarized. The piezoelectric sheets 24, to which the electric field is applied, are contracted as active layers in a direction orthogonal to the polarization direction by the piezoelectric horizontal effect. On the other hand, the top plate 15 does not contract by itself (voluntarily) because the top plate 15 is not affected by the electric field. Consequently, there is caused a difference in the distortion (warpage), in the direction orthogonal to the polarization direction, between the top plate 15 as a lower-side layer and the piezoelectric sheets 24 as an upper-side layer. Since the top plate 15 is fixed to the cavity plate 14A, the piezoelectric sheets 24 and the top plate 15 are deformed to project toward the pressure chambers 14Aa (unimorphic deformation). As a result, the volume of the pressure chambers 14Aa is decreased, and thus the pressure in the pressure chambers 14Aa is increased, thereby discharging the ink from the nozzles 16. Afterwards, when the electric potential of the surface electrodes 21 are returned to be same as that of the inner common electrodes 20, the piezoelectric sheets 24 and the top plate 15 are returned to their original forms respectively, which in turn makes the volume of the pressure chambers 14Aa to their original volume to thus decrease the increased pressure in the pressure chambers 14Aa, thereby making the ink flow into the pressure chambers 14Aa from the manifold 14Da, 14Ea. In a similar manner as described above, the operation for ink discharge can be repeated.

As described above, in this embodiment, the top plate 15 is provided, as a vibration plate, in the upper portion of the cavity unit 11. Accordingly, it is possible to realize excellent discharge efficiency with the unimorphic deformation.

As described above, the cavity unit 11 includes the nozzles 16*a*; the pressure chambers 14Aa communicating with the nozzles 16*a*, respectively; and the manifolds 14Da, 14Ea which temporarily store the ink to be supplied to the pressure chambers 14Aa. On the other hand, the actuator unit 12 includes the individual surface electrodes 21 corresponding to the pressure chambers 14Aa respectively, and supplies the drive signal to the individual surface electrodes 21 to change the volume of the pressure chambers 14Aa, thereby discharging the ink from the nozzles 16.

Next, an explanation will be given regarding the connection of the signal lines 31 of the flexible cable 13 (COP) and the individual surface electrodes 21, with reference to FIGS. 4 to 7.

Figure 4A:
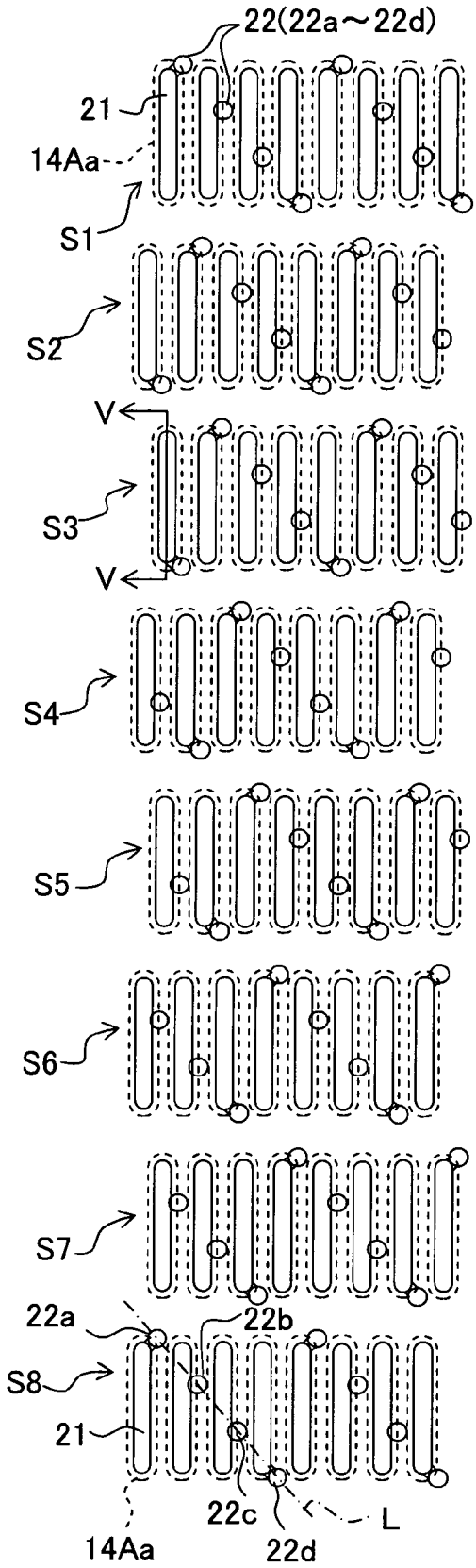

As shown in FIG. 4A, the individual surface electrodes 21 having a shape of elongated ellipse and the land portions 22 having a circular shape are arranged in a regular manner on the upper surface of the actuator unit 12 so as to correspond to the pressure chambers 14Aa, respectively. Each of the individual surface electrodes 21 is formed at a position corresponding to one of the pressure chambers 14Aa of the actuator unit 15, and overlaps in a plan view with one of the pressure chambers 14Aa. The land portions 22 having the circular shape are provided corresponding to the individual surface electrodes 22, respectively, and the individual surface electrodes 21 and the land portions 22 are electrically conducted, respectively.

The pressure chambers 14Aa are arranged such that the pressure chambers 14Aa forms a plurality of pressure-chamber rows S1 to S8 linearly aligned in a direction different from the longitudinal direction of the pressure chambers 14Aa (in this embodiment, a direction orthogonal to the longitudinal direction of the pressure chambers 14Aa). Accordingly, the individual surface electrodes 21, provided to correspond to the pressure chambers 14Aa, respectively, are also arranged in a plurality of rows aligned linearly in the direction different from the longitudinal direction of the pressure chambers 14Aa. The pressure-chamber rows S1 to S8 are used for color inks of different colors every two rows in the rows, respectively, and include rows of color-specific or color-designated pressure chambers in which every two rows are designated for one of magenta ink, cyan ink, yellow ink, and black ink.

The land portions 22 are arranged such that a certain land portion 22, which is among the land portions 22 and is conducted to a certain individual surface electrode 21 among the individual electrodes 21 and corresponding to a certain pressure chamber 14Aa belonging to one of the pressure-chamber rows S1 to S8, is formed at a space between an individual surface electrode, among the individual surface electrodes and conducted with the land portion, and another individual surface electrode adjacent to the individual surface electrode corresponding to another pressure chamber 14Aa adjacent to the certain pressure chamber 14Aa and also forming the same pressure-chamber row to which the certain pressure chamber 14Aa belongs. The diameter of the land portions 22 is smaller than the spacing distance between the individual surface electrodes 21, and the land portions 22 are provided such that a certain land portion 22, conducted to an individual surface electrode 21, is disposed between the individual surface electrode 21 and another individual surface electrodes 21 next to the individual surface electrode 21, at a position nearer to the individual surface electrode to which the land portion 22 is conducted.

Accordingly, a gap (space) is provided between a land portion 22 and an individual surface electrode 21 adjacent to the land portion 22, such that the land portion 22 and the adjacent individual surface electrode 21 do not make an electric contact. Further, in this embodiment, the land portions 22 are arranged such that not only a gap is formed between a land portion 22 and an individual surface electrode 21 adjacent to the land portion 22, but also such that a certain land portion 22 conducted to a certain individual surface electrode does not overlap in a plan view with a pressure chamber 14Aa for (corresponding to) another individual surface electrode 21 which is adjacent to the individual surface electrode to which the certain land portion 22 is conducted.

Figure 4B:
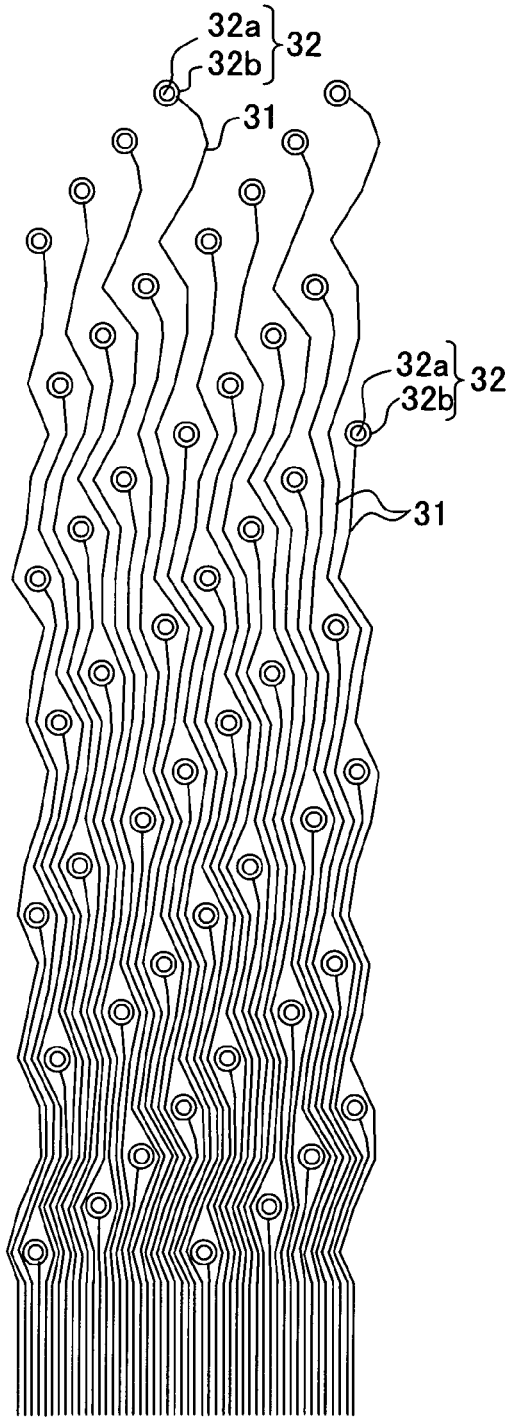

As shown in FIG. 4B, the signal lines 31 of the flexible cable 13 are formed as a conductive pattern on a substrate 13*a* (see FIG. 1B) which is flexible, which has an insulating property, and which is formed in a band-like shape extending in the longitudinal direction of the pressure chambers 14Aa. The connection terminal 32 of each of the signal lines 31 is formed as a copper-foil portion 32*b* formed with a through hole 32*a* through a center of the copper-foil portion 32*b*. The signal lines 31 which supply the drive signal are drawn in a same direction, and a drawing direction in which the signal lines are drawn is parallel to the longitudinal direction of the pressure chambers 14Aa.

Figure 6:
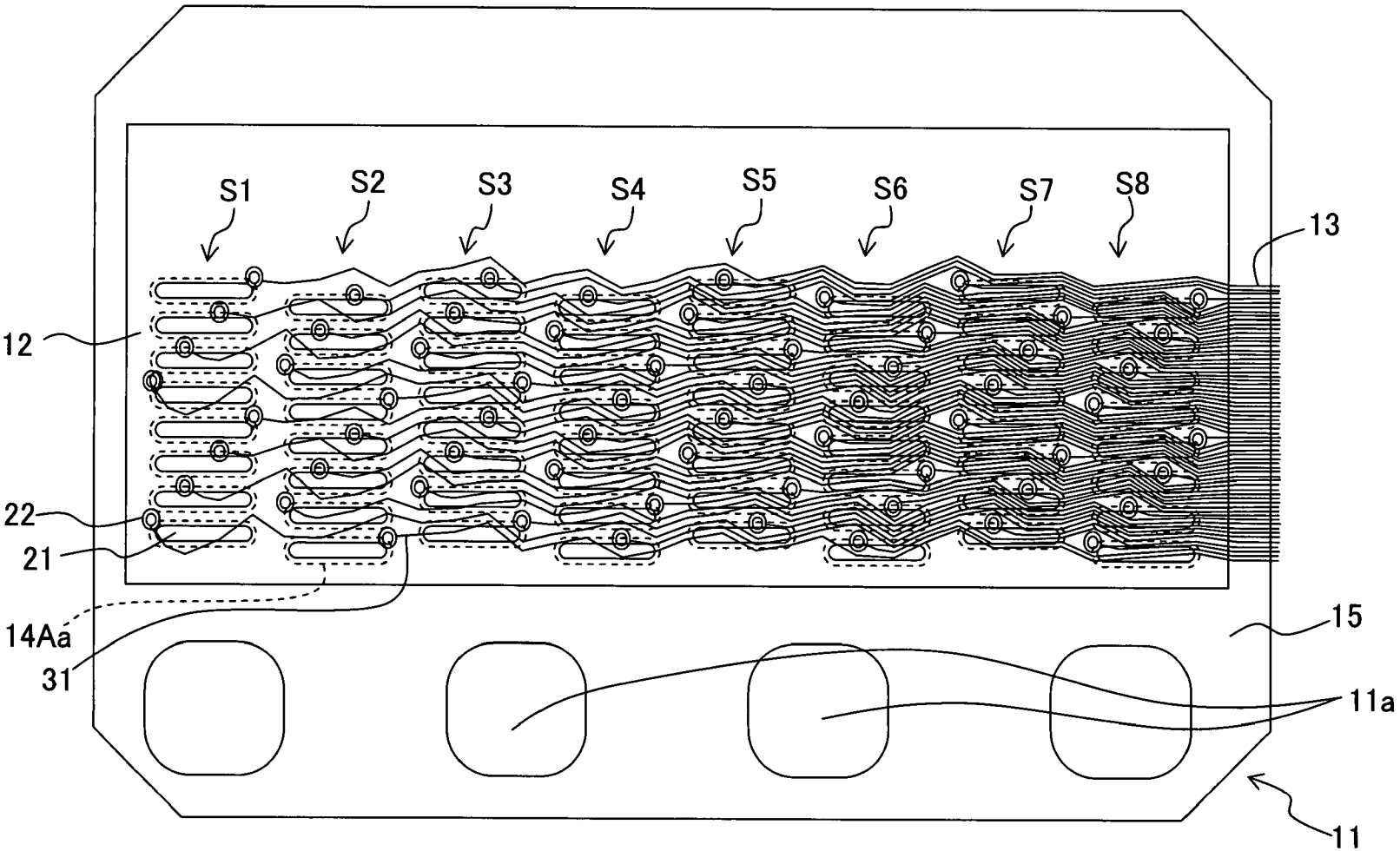
FIG. 6 is a plan view showing a state in which the connection terminals are connected to the individual surface electrodes.
Figure 7:
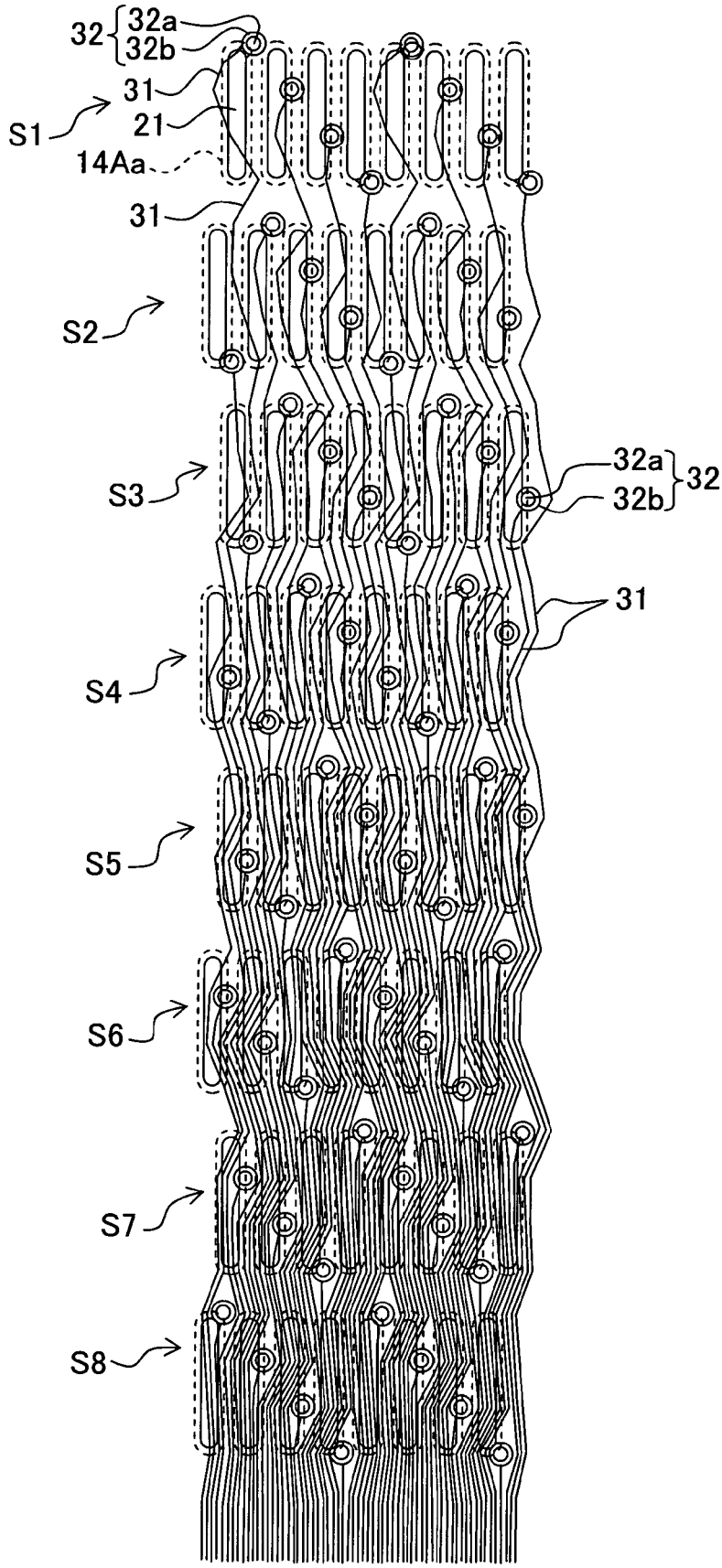
FIG. 7 is a partially enlarged view showing a state in which the connection terminals of the signal lines are connected to the individual surface electrodes.

The connection terminal 32 of each of the signal lines 31 is arranged in the substrate, which is flexible and has insulating property, to correspond to one of the land portions 22 conducted to the individual surface electrodes 21 respectively. By filling solder into the through hole 32*a* formed in the connection terminal 32 of each of the signal lines 31, the connection terminal 32 is electrically connected to each of the individual surface electrodes 21 via one of the land portions 22, as shown in FIGS. 6 and 7.

The land portions 22 are arranged such that a certain land portion 22 conducted to a certain individual surface electrode 21 corresponding to a certain pressure chamber in one of the pressure-chamber rows S1 to S8 is arranged to shift in the longitudinal direction of the pressure chamber 14Aa from another land portion 22 conducted to another individual surface electrode 21 corresponding to another pressure chamber 14Aa adjacent to the certain pressure chamber 14Aa in the same pressure-chamber row. In this embodiment, the land portions 22 are divided into groups (land portion groups) by every four pieces of the land portion 22, the groups being adjacent to one another in each of the pressure-chamber rows S1 to S8, and a same arrangement pattern is repeated for each of the groups, thereby simplifying the arrangement pattern.

Specifically, as shown in FIG. 4A, a plurality of land portions 22*a*, 22*b*, 22*c* and 22*d* forming each of the groups is arranged along a straight line L inclined with respect to the longitudinal direction of the pressure chamber 14Aa. The land portions 22*a* and 22*d*, disposed at both ends respectively in each of the groups, are arranged at portions respectively, which are in the vicinity of end portions in the longitudinal direction of the pressure chambers 14Aa, so that a spacing distance can be secured as wide as possible between the land portions.

In each of the groups, the land portions 22*a* to 22*d* are arranged at an equal spacing distance in the longitudinal direction of the pressure chambers 14Aa, and the spacing distance between the land portions 22*a* to 22*d* adjacent to one another is wider than in a case in which the land portions 22*a* to 22*d* are aligned horizontally to one another. By such an arrangement, as shown in FIGS. 4B and 6, in the flexible cable 13, the connection terminals 32 are arranged corresponding to the land portions 22. Accordingly, the spacing distance between the connection terminals 32 also becomes wider than in a case in which the connection terminals 32 are arranged horizontally to one another. Thus, it is possible to perform wiring for the signal lines 31, which are formed as the conductive pattern on the flexible substrate, can be performed in a non-narrow manner (with enough space) between the connection terminals 32.

The present invention is not intended to be limited to the embodiment as described above, and is applicable to the following modified embodiments.

First Modified Embodiment

Figure 8A:
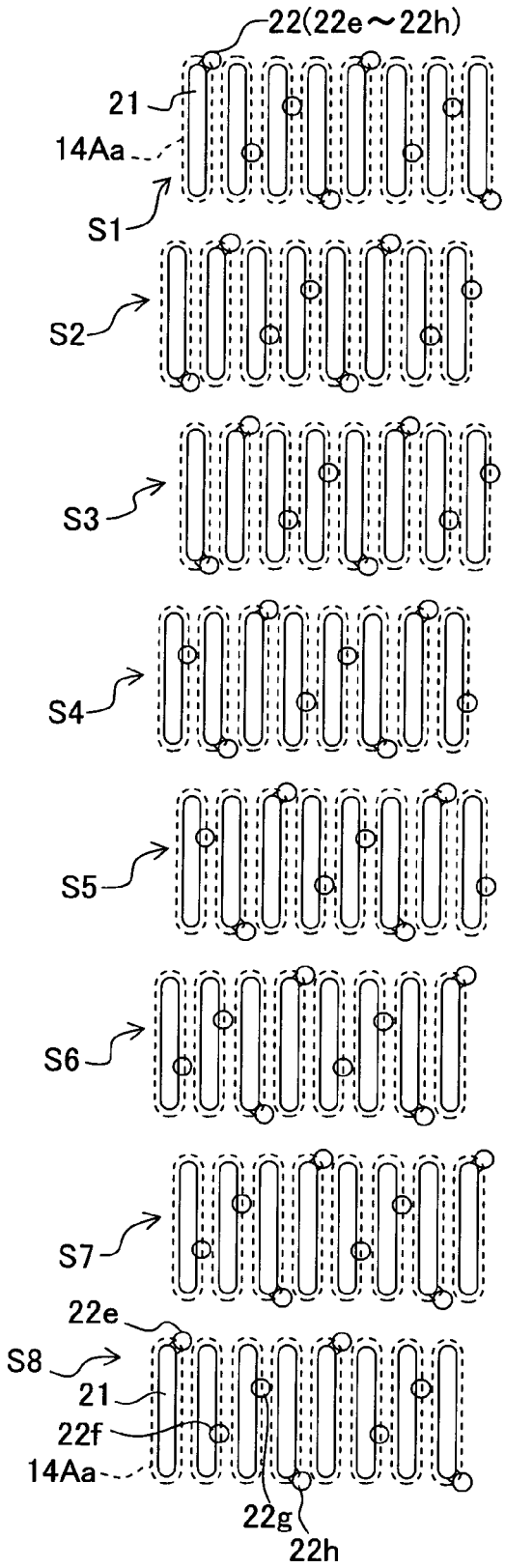
Figure 8B:
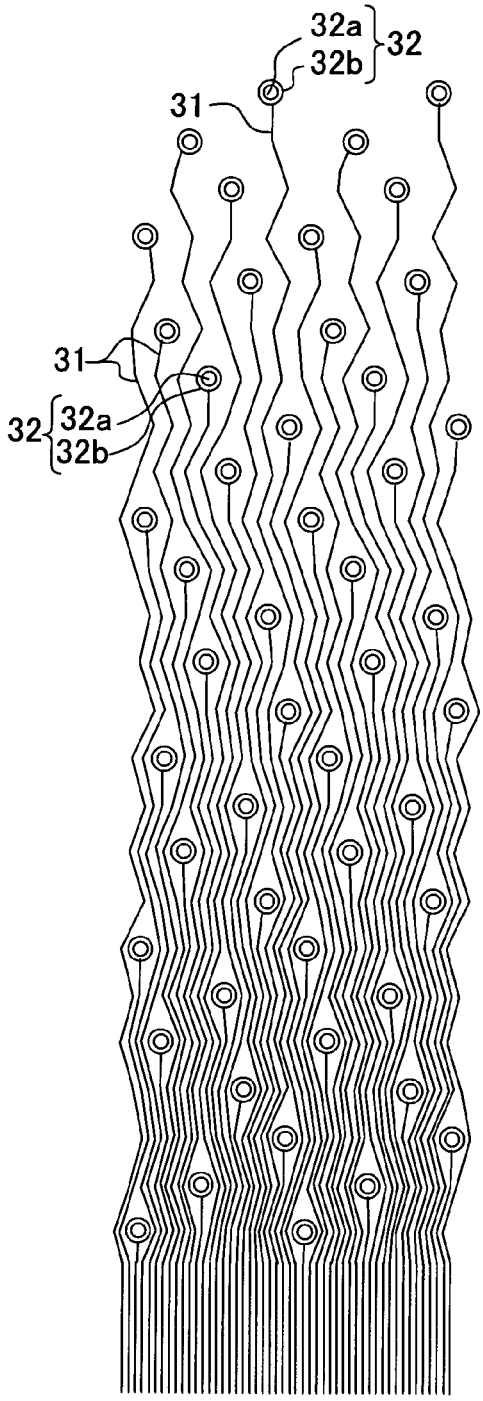
Figure 9:
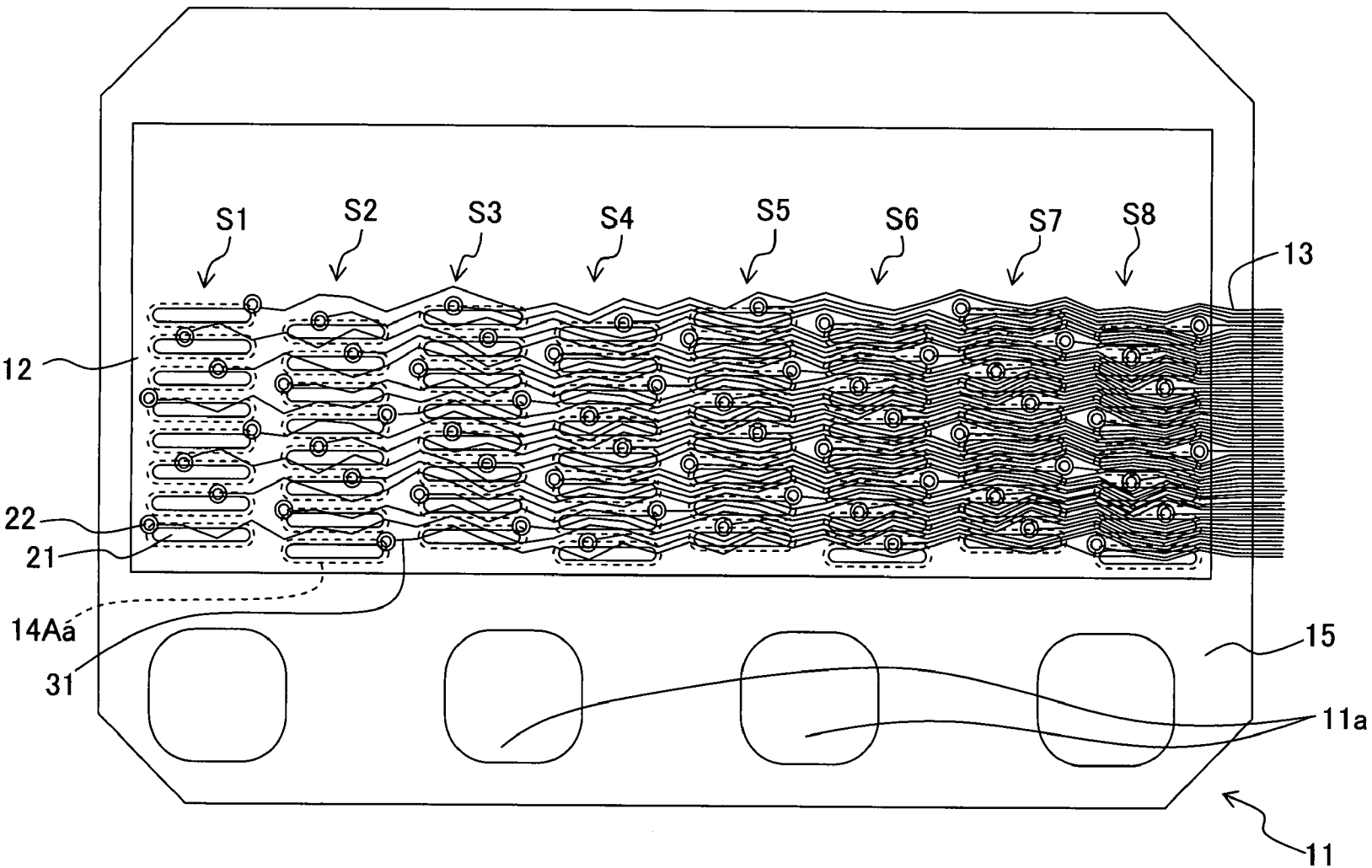
FIG. 9 is a plan view showing a state in which the connection terminals of the signal lines are connected to the individual surface electrodes.
Figure 10:
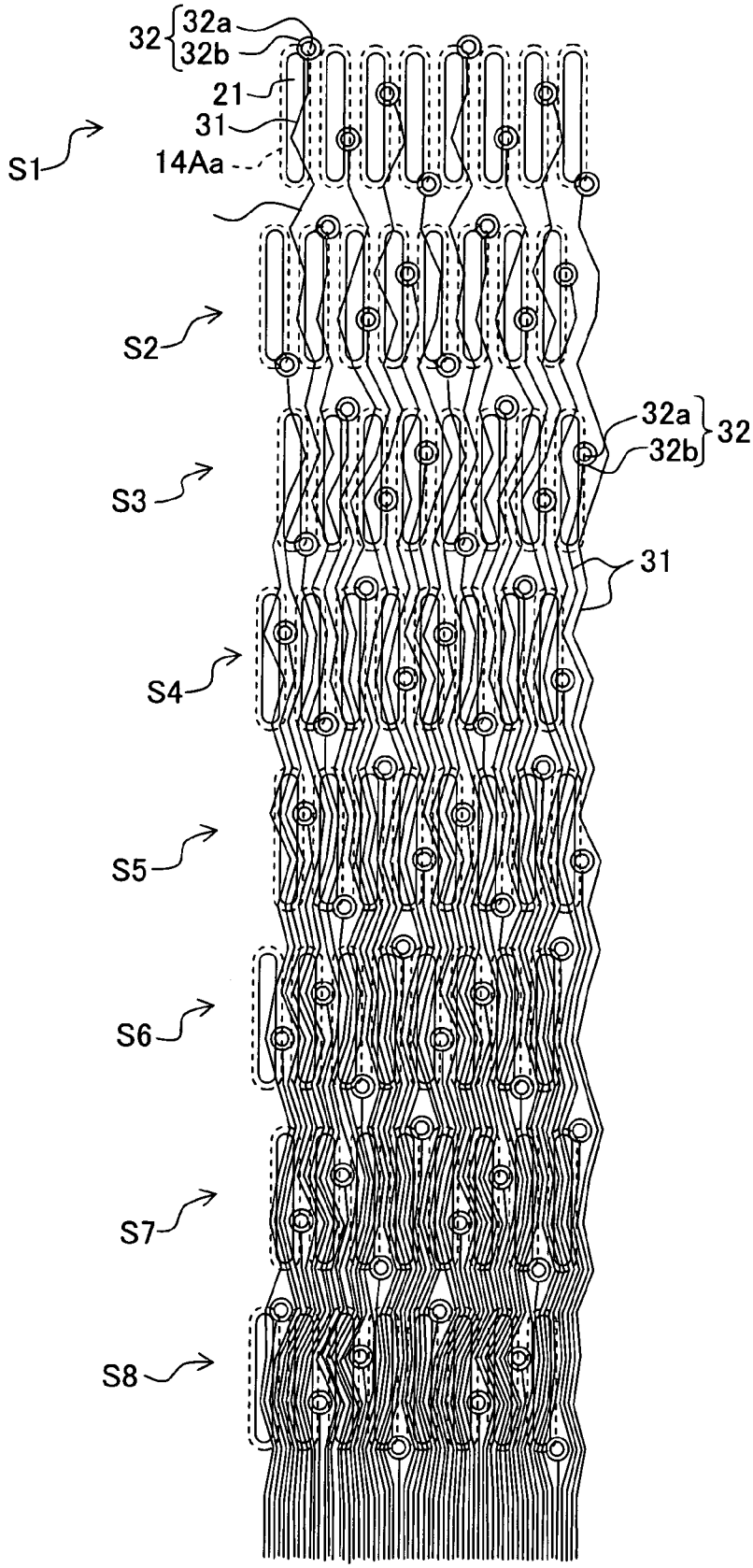
FIG. 10 is a partially enlarged view showing a state in which the connection terminals of the signal lines are connected to the individual surface electrodes.
Figure 11:
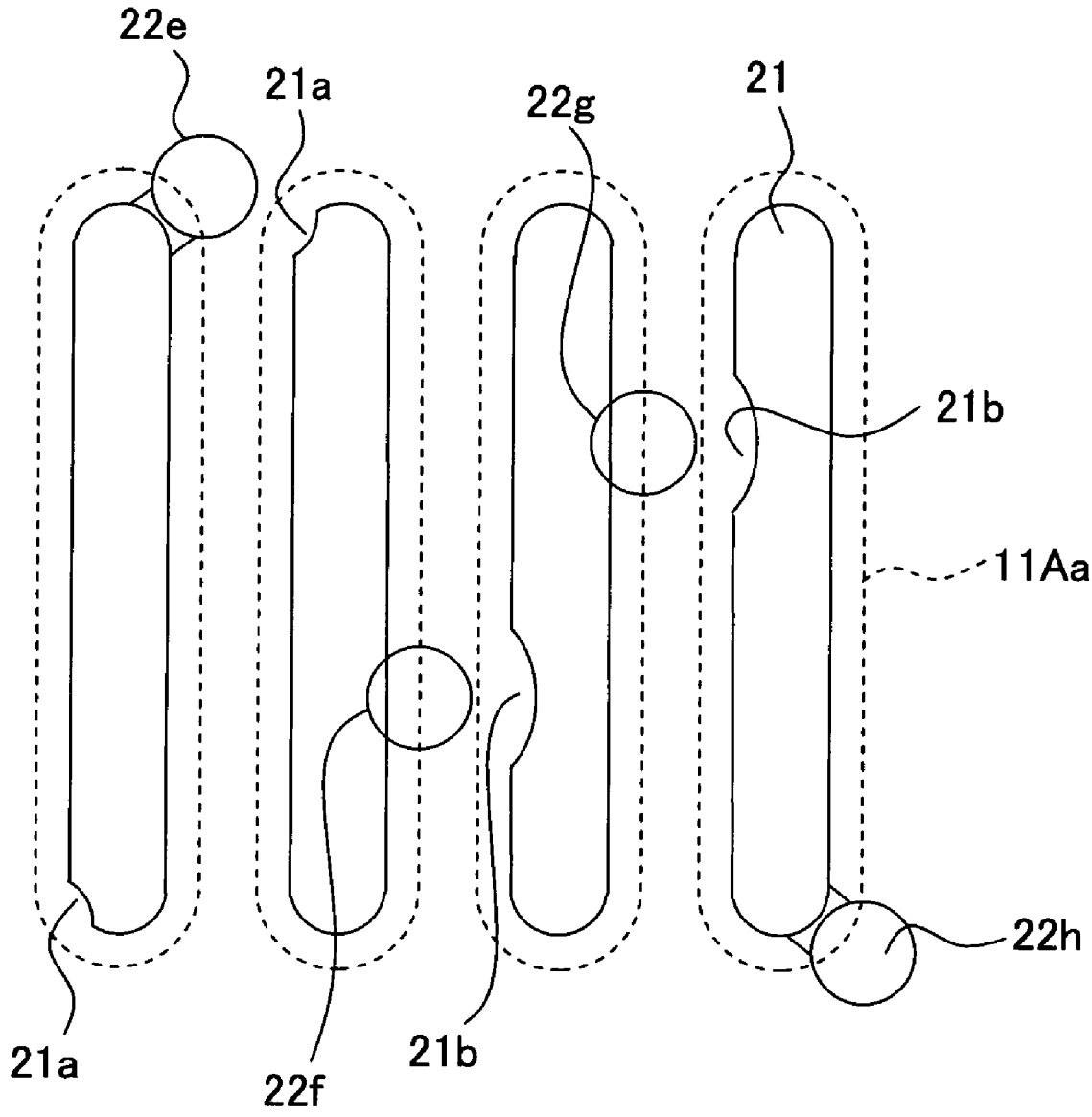
FIG. 11 shows another embodiment of the first modified embodiment of the present invention, showing a relationship between the individual surface electrodes and pressure chambers.

The arrangement of the plurality of land portions constructing each of the groups is not limited to the arrangement in which the land portions are arranged on the straight line L inclined with respect to the longitudinal direction of the pressure chambers 14Aa. For example, the land portions may be arranged as shown in FIGS. 8 to 10.

In this case, a plurality of land portions 22*e*, 22*f*, 22*g* and 22*h* constructing each of the groups are arranged one by one at a uniform spacing distance in the longitudinal direction of the pressure chambers 14Aa. Further, in each of the groups, the spacing distance is widest between the land portions 22*e* and 22*h* disposed at both ends, respectively, of each of the groups, and the remaining land portions 22*f* and 22*g* are not arranged on a straight line connecting the two land portions 22*e* and 22*h*. The land portions 22*e* to 22*h* in this modified embodiment are arranged in the same way as the land portions 22*a* to 22*d* shown in FIGS. 4 to 7 except that positions at which two land portions 22*b* and 22*c*, disposed in the center in each of the groups, are switched (counterchanged) in the arrangement.

Further, upon soldering the land portions 22*e* to 22*h* and the connecting terminals 32, for preventing any electrical conduction from accidentally occurring between a certain connection terminal 32 conducted to a certain individual surface electrode 21 and another individual surface electrode 21 adjacent to the certain individual surface electrode 21, it is also possible to form notches 21*a* or 21*b* in an electrode portion of each of the individual surface electrodes 21 such that a certain individual surface electrode 21 avoids any contact with one of the land portions 22*e* to 22*h* conducted to another individual surface electrode 21 which is adjacent to the certain individual surface electrode 21. In this case also, in the flexible cable 13, the spacing distance may be wider between the connection terminals 32 arranged corresponding to the land portions 22, respectively, than in a case in which the connection terminals 32 are aligned horizontally to one another. Further, upon electrically connecting the connection terminals 32 of the flexible cable 13 and the land portions 22 of the actuator unit 12 with solder or the like, it is necessary to press the flexible cable 13 against the actuator unit 12. At this time, it is possible to press the flexible cable 13 against the actuator unit 12 in a more uniform and balanced manner than in a case in which the land portions are linearly arranged (arranged along a straight line).

Second Modified Embodiment

In the above-described embodiment, each of the group of the individual surface electrodes includes four individual surface electrodes. However, the number of the individual electrodes included in each of the groups is not limited to four, and the number of the individual surface electrodes forming each of the groups may be three, five or not less than five.

Third Modified Embodiment

Although in the above-described embodiment, the pressure chambers 14Aa include color-designated pressure chambers to which inks of different colors (magenta, cyan, yellow and black) are supplied respectively, there is no limitation to the color of the ink supplied to pressure chambers 14Aa corresponding to individual surface electrodes 21 on the signal-line drawn side at which the signal lines 31 are drawn. In the following case, however, it is desired that pressure chambers to which the black ink is supplied are arranged on the signal-line drawn side.

Since a large ink discharge amount is generally required for the black ink, the length of pressure chambers 14Aa and the length of manifolds 14Da, 14Ea for the black ink are greater than those for other colors other than black for purpose of the stable ink discharge. In such a case, the length of individual surface electrodes 21 formed corresponding to the pressure chamber 14Aa for the black ink is greater than the length of individual surface electrodes 21 for the colors other than black. Accordingly, it is possible to make the spacing distance, in the longitudinal direction of the pressure chambers 14Aa, between the land portions greater than the spacing distance between the land portions corresponding to the pressure chambers for the colors other than black. Thus, it is possible to secure, in a non-tight manner, the wiring pitch of the conductive pattern of the signal lines 31 on the signal-line drawn side at which the number of the signal lines 32 becomes great and the wiring pitch of the signal lines 31 becomes narrow, by arranging the pressure chambers 14Aa for the black ink on the signal-line drawn side.

Fourth Modified Embodiment

Although in the above-described embodiment, the individual surface electrodes in all of the pressure-chamber rows are arranged such that a certain individual surface electrode is arranged to shift, in the longitudinal direction of the pressure chamber, from another individual surface electrode adjacent to the certain individual surface electrode, the present invention is not limited to this arrangement. It is possible to perform an arrangement, at least regarding a pressure-chamber row disposed most closely to the signal-line drawn side, or regarding a plurality of pressure-chamber rows disposed in the vicinity of the signal-line drawn side and including the pressure-chamber row disposed most closely to the signal-line drawn side, such that the land portions conducted to the individual surface electrodes are arranged to shift from one another in the longitudinal direction of the pressure chambers. The wiring pitch of the signal lines is narrowest in the signal-line drawn side. Therefore, the effect of simplifying the wirings can be obtained when at least the land portions, conducted with the individual surface electrodes on the signal-line drawn side, are arranged to shift from one another in the longitudinal direction of the pressure chambers.

Fifth Modified Embodiment

Although in the above-described embodiment, the land portions are arranged at a constant spacing distance, the present invention is not limited thereto. Since the wiring pitch of the signal lines becomes the tightest or narrowest on the signal-line drawn side, the following arrangement can also be adopted in which a spacing distance between land portions belonging to a certain group, which is located nearer to the signal-drawn side, is wider than a spacing distance between land portions belonging to another group which is located farther from the signal-line drawn side than the certain group. Alternatively, an arrangement may be adopted in which, in a group, the spacing distance between the land portions only on the signal-line drawn side may be widest than the remaining land portions belonging to the group.

Sixth Modified Embodiment

Although in the above-described embodiment, the actuator unit has the inner common electrodes each formed over or above one of the pressure chambers, the piezoelectric sheets each formed on one of the inner common electrodes, and the individual surface electrodes each formed on one of the piezoelectric sheets, the present invention is not intended to be limited thereto. The present invention is applicable also to an actuator unit provided with sheet materials each of which includes a piezoelectric ceramics and which are stacked in a plurality of layers and extending over or across a plurality of pressure chambers so as to cover the pressure chambers; a plurality of individual electrodes and a plurality of common electrodes which correspond to one of the pressure chambers, the individual electrodes and the common electrodes being provided between the stacked sheet materials and arranged alternately between the sheet materials in a direction in which the sheet materials are stacked, wherein one of the common electrodes is arranged at a position closest to a cavity unit.

What is claimed is:

1. A head for ink-jet printer which discharge an ink, the head comprising:

a cavity unit including a plurality of nozzles, a plurality of elongated pressure chambers communicating with the nozzles respectively, and a manifold storing the ink to be supplied to the pressure chambers;

an actuator unit having individual surface electrodes which are formed corresponding to the pressure chambers, respectively; and land portions which are conducted to the individual surface electrodes respectively and which are formed, corresponding the pressure chambers respectively, such that a land portion among the land portions is formed between an individual surface electrode, among the individual surface electrodes and conducted with the land portion, and another individual surface electrode adjacent to the individual surface electrode; the actuator changing volume of the pressure chambers respectively, when driving signal is supplied to the individual surface electrodes respectively, so as to discharge the ink from the nozzles; and a flexible cable arranged to overlap with the actuator unit, and having a flexible and insulative substrate, a plurality of connection terminals which are formed on the substrate, and signal lines formed on the substrate and drawn from the connection terminals respectively; wherein:

the land portions are electrically connected to the connection terminals, respectively; and three land portions, among the land portions, which are adjacent to one another in a short direction of the pressure chambers and on a signal-line drawn side at which the signal lines are drawn, are arranged at three positions different in a longitudinal direction of the pressure chambers respectively.

2. The head for ink-jet printer according to claim 1, wherein:

the pressure chambers form a plurality of pressure-chamber rows aligned in a row-direction which is different from the longitudinal direction;

the signal lines are drawn in a direction intersecting the row-direction; and the land portions are arranged such that, a land portion, among the land portions, which is conducted to an individual surface electrode among the individual surface electrodes and corresponding to a pressure chamber forming a pressure-chamber row among the pressure-chamber rows and being on the signal-line drawn side, is arranged between the individual surface electrode and another individual surface electrode corresponding to another pressure chamber which is adjacent to the pressure chamber and which also forms the pressure-chamber row on the signal-line drawn side.

3. The head for ink-jet printer according to claim 2, wherein:

land portions, among the land portions, which correspond to pressure chambers, respectively, among the pressure chambers and forming one of the pressure-chamber rows, form a plurality of land portion groups which are adjacent to each other and each of which includes land portions adjacent to one another; and an arrangement pattern, in which the land portions are arranged, is same among the land portion groups.

4. The head for ink-jet printer according to claim 3, wherein the land portions, forming each of the land portion groups, are arranged along a straight line inclined with respect to the longitudinal direction of the pressure chambers.

5. The head for ink-jet printer according to claim 3, wherein:

the land portions forming each of the land portion groups are arranged one by one at a constant spacing distance in the longitudinal direction of the pressure chambers; and a spacing distance in the longitudinal direction of the pressure chambers is widest between land portions among the land portions and located at both ends, respectively, in each of the land portion groups, and remaining land portions, except for the land portions located at the both ends, are arranged to deviate from a straight line connecting the land portions located at the both ends in each of the land portion groups.

6. The head for ink-jet printer according to claim 2, wherein:

the row-direction of the pressure-chamber rows is orthogonal to the longitudinal direction of the pressure chambers; and a direction in which the signal lines are drawn is parallel to the longitudinal direction of the pressure chambers.

7. The head for ink-jet printer according to claim 1, wherein notches are formed in the individual surface electrodes, respectively, each of the notches corresponding to a land portion among the land portions and conducted to an individual surface electrode among the individual surface electrodes and adjacent to another individual surface electrode in which each of the notches is formed.

8. The head for ink-jet printer according to claim 1, wherein:

the pressure chambers include color-designated pressure chambers to which a plurality of color inks are supplied respectively, the color inks including a black ink; and the black ink is supplied to a color-divided pressure chamber among the color-divided pressure chambers and corresponding to an individual electrode among the individual electrodes and being on the signal-line drawn side.

9. The head for ink-jet printer according to claim 1, wherein:

the actuator unit further includes inner electrodes formed above the pressure chambers, respectively, and piezoelectric sheets each formed on a surface of one of the inner electrodes; and each of the individual surface electrodes is formed on a surface of one of the piezoelectric sheets.

10. The head for ink-jet printer according to claim 1, wherein with respect to different land portions, among the land portions, which are different from the three land portions which are adjacent to one another in the short direction of the pressure chambers and on the signal-line drawn side, three land portions adjacent to one another in the short direction of the pressure chambers are arranged at three positions different in the longitudinal direction of the pressure chambers respectively.

11. The head for ink-jet printer according to claim 1, wherein with respect to land portions among the land portions and being on the signal-line drawn side, four land portions which are adjacent to one another in the short direction of the pressure chambers are arranged to shift from one another in the longitudinal direction of the pressure chambers.

12. The head for ink-jet printer according to claim 1, wherein the head includes only one piece of the flexible cable.

13. A flexible cable connectable to an head for an ink-jet printer, the head including: a cavity unit including a plurality of nozzles, a plurality of elongated pressure chambers communicating with the nozzles respectively, and a manifold storing an ink to be supplied to the pressure chambers; and an actuator unit having individual surface electrodes corresponding to the pressure chambers, respectively, and land portions which are conducted to the individual surface electrodes respectively and which are formed, corresponding to the pressure chambers respectively, such that a land portion among the land portions is formed between an individual surface electrode, among the individual surface electrodes and conducted with the land portion, and another individual surface electrode adjacent to the individual surface electrode, the actuator changing volume of the pressure chambers respectively, when driving signal is supplied to the individual surface electrodes respectively, so as to discharge the ink from the nozzles, the flexible cable comprising:

a flexible and insulative substrate which is band-shaped;

a plurality of connection terminals which are formed on the substrate; and a plurality of signal lines formed on the substrate and drawn, in an extending direction in which the substrate extends, from the connection terminals respectively, the signal lines supplying driving signal to the individual surface electrodes respectively;

wherein three connection terminals, among the connection terminals, which are adjacent to one another in a direction different from the extending direction and arranged in the substrate on a signal-line drawn side at which the signal lines are drawn, are formed at positions shifted from one another in the extending direction.

14. The flexible cable according to claim 13, wherein each of the connection terminals is a copper-foil portion formed with a through hole at a center of the copper-foil portion.

15. An ink-jet printer which discharges an ink to perform recording on a recording medium, the ink-jet printer comprising:

a head for ink-jet printer which includes a cavity unit having a plurality of nozzles, a plurality of elongated pressure chambers communicating with the nozzles, respectively, and a manifold storing the ink to be supplied to the pressure chambers; an actuator unit which has individual surface electrodes corresponding to the pressure chambers, respectively, and land portions which are conducted to the individual surface electrodes respectively and which are formed, corresponding to the pressure chambers respectively, such that a land portion among the land portions is formed between an individual surface electrode, among the individual surface electrodes and conducted with the land portion, and another individual surface electrode adjacent to the individual surface electrode, the actuator changing volume of the pressure chambers respectively when driving signal is supplied to the individual surface electrodes respectively so as to discharge the ink from the nozzles; and a flexible cable arranged to overlap with the actuator unit and having a flexible and insulative substrate, a plurality of connection terminals formed on the substrate, and signal lines formed on the substrate and drawn from the connection terminals, respectively;

a carriage which is movable while supporting the head for ink-jet printer; and drive control unit which is connected to one end of the flexible cable, which supplies the driving signal to the individual surface electrodes, and which supplies a signal for controlling drive of the carriage to the carriage;

wherein the land portions are electrically connected to the connection terminals, respectively; and three land portions, among the land portions, which are adjacent to one another in a short direction of the pressure chambers and on a signal-line drawn side at which the signal lines are drawn, are arranged at three positions different in the longitudinal direction of the pressure chambers respectively.

16. The ink-jet printer according to claim 15, wherein the head includes only one piece of the flexible cable.

* * * * *